United States Patent [19]

Morse

[11] 4,029,217

[45] June 14, 1977

[54] PIPE-HANDLING CRAMPON

[76] Inventor: Charles Richard Morse, P.O. Box 1561, Anchorage, Alaska 99510

[22] Filed: Jan. 15, 1975

[21] Appl. No.: 541,264

[52] U.S. Cl. ..... 214/1 P; 214/147 G

[51] Int. Cl.[2] ..... B65G 41/00

[58] Field of Search ..... 214/1 P, 1 PA, DIG. 3, 214/147 R, 147 G, DIG. 1, DIG. 4, 620

[56] References Cited

UNITED STATES PATENTS

| | | | |
|---|---|---|---|
| 2,752,056 | 6/1956 | Lull | 214/DIG. 3 |
| 2,848,123 | 8/1958 | Keys | 214/130 C |
| 3,050,206 | 8/1962 | McCracken | 214/620 |
| 3,487,964 | 1/1970 | Riley | 214/147 R |
| 3,561,613 | 2/1971 | Moad | 214/1 P |
| 3,606,441 | 9/1971 | Ridgely | 214/1 PA |
| 3,796,332 | 3/1974 | Kawamura | 214/147 G |
| 3,861,734 | 1/1975 | Welch | 214/1 PA |

*Primary Examiner*—Joseph F. Peters, Jr.
*Assistant Examiner*—John A. Carroll
*Attorney, Agent, or Firm*—Robert W. Beach

[57] ABSTRACT

Pipe-gripping heads are movable along a pipe-spanning frame to grip opposite ends of a pipe. The length of the pipe-spanning frame extends transversely of the length of a boom which is carried and movable elevationally by a lift truck. The pipe-spanning frame is carried by and can be moved longitudinally of the boom or swung about an upright axis relative to the boom or tilted by swiveling the boom. The boom can be shortened by swinging upward an outboard draw section.

26 Claims, 16 Drawing Figures

PIPE-HANDLING CRAMPON

The present invention relates to a length-handling crampon which can be used, for example, for unloading lengths of pipe or structural steel from a vehicle and stacking them in a stockpile and which, subsequently, can lift such pipe or structural steel lengths from a stockpile and load them onto a vehicle.

A principal object of the invention is to provide a device which can handle long lengths of large pipe quickly and easily without manual labor.

A further object is to provide a device for handling lengths of pipe, structural steel or other elongated articles, which can move such lengths conveniently transversely of their lengths, which can tilt such lengths, or which can swing such lengths about an upright axis.

Another object is to provide a pipe-handling device which is compact and can grip a pipe positively so as to manipulate the pipe quickly under complete control.

It is also an object to provide a pipe-handling device which can be altered or adjusted easily to handle pipe of considerably different lengths and diameters.

FIG. 1 is a side elevation of a pipe-handling crampon of the present invention, and FIG. 2 is a similar view showing parts in different adjusted positions.

FIG. 3 is an enlarged elevation of the crampon with parts broken away. FIG. 4 is a further enlarged front elevation of one end portion of the crampon having parts broken away. FIG. 5 is a detail of the structure shown in FIG. 4. FIG. 6 is an enlarged elevation of a portion of the structure shown in FIG. 3 with parts broken away, and FIG. 7 is a vertical section taken on line 7—7 of FIG. 6. FIG. 8 is a top perspective of a portion of the structure shown in FIG. 4.

Figure 12:
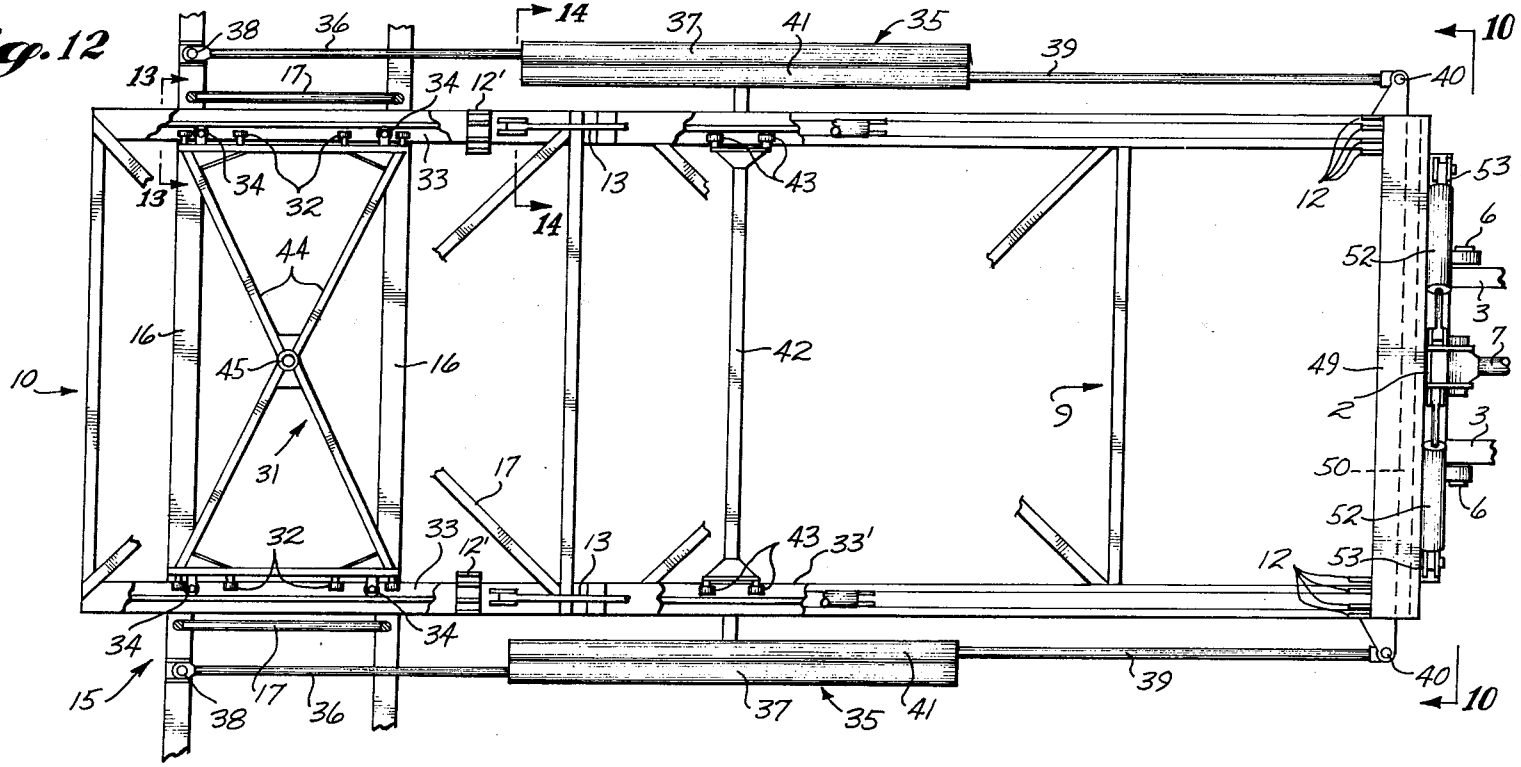
Figure 14:
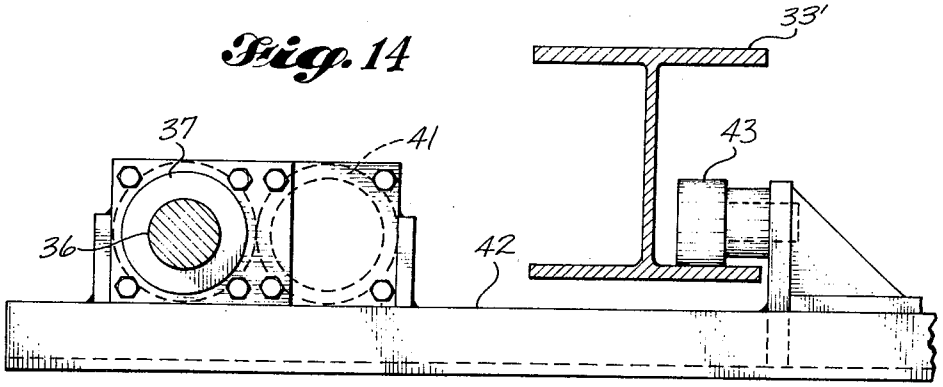
Figure 13:
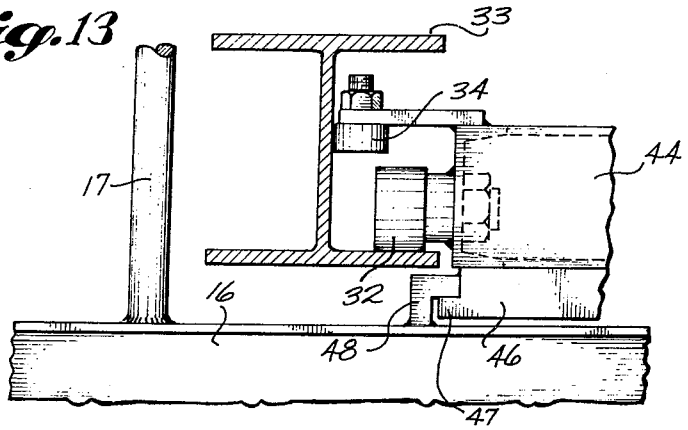

FIG. 12 is a plan of a portion of the crampon showing mechanism for translating a pipe held by the crampon. FIG. 13 is a detail vertical section of a portion of the structure shown in FIG. 12 taken on line 13—13 of FIG. 12. FIG. 14 is a detail vertical transverse section of a portion of the structure shown in FIG. 12 along line 14—14 of that figure.

Figure 15:
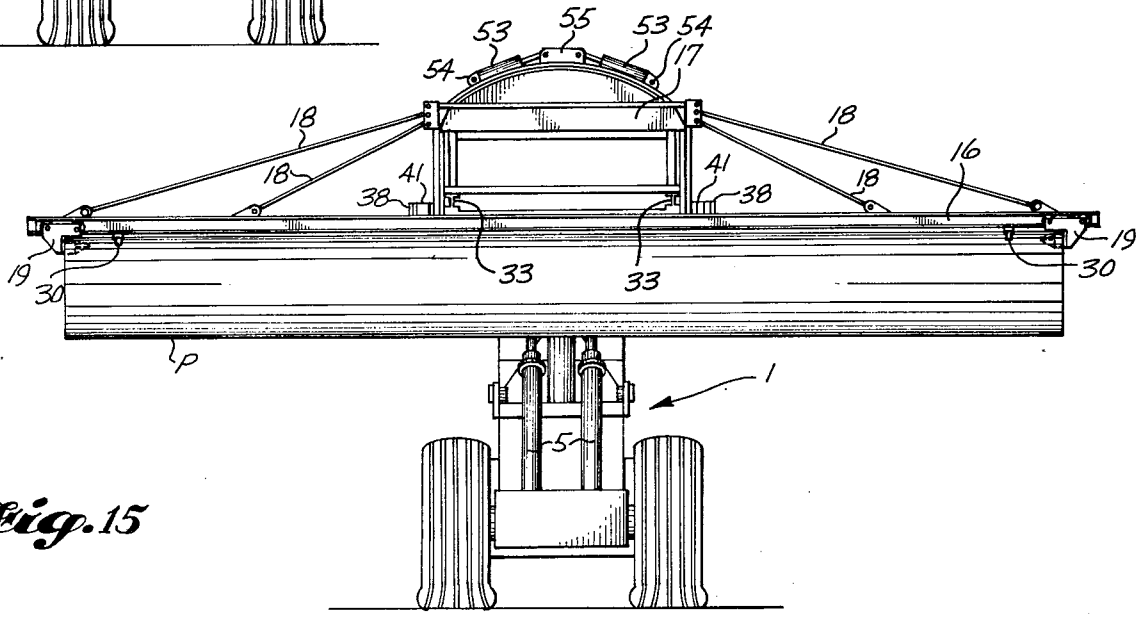

FIG. 15 is a front elevation of a modified crampon.

Figure 16:
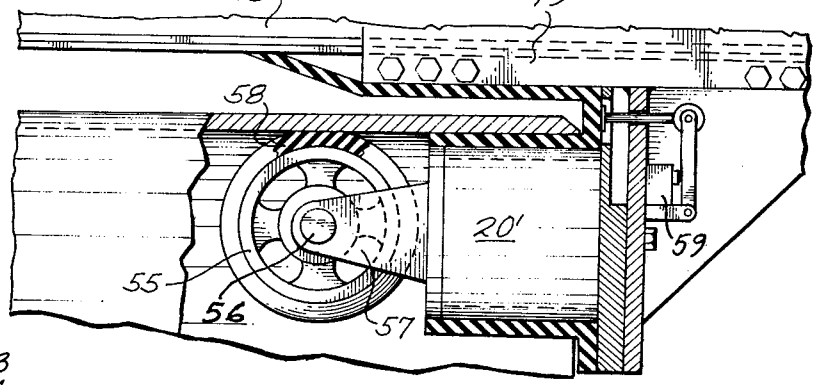
Figure 3:
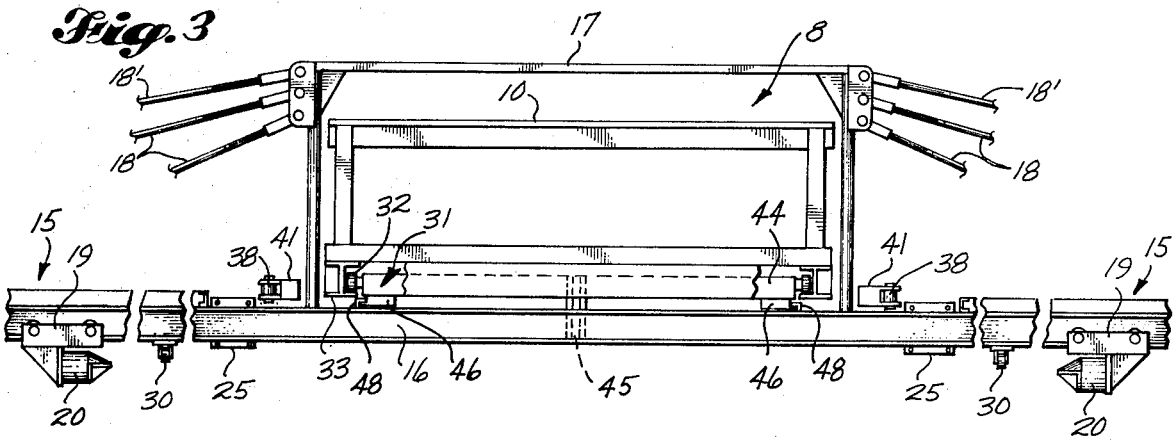

FIG. 16 is an enlarged elevation of a portion of the structure shown in FIG. 3 with parts broken away illustrating an alternate type of construction.

While the length-handling crampon of this invention could be used for picking up and transporting lengths of pipe, structural steel or comparable articles for any distance desired, it is most useful for handling lengths at a particular location and perhaps moving such lengths for short distances. Typical uses are for unloading lengths from a truck, a railway car or a pallet and loading such lengths on another vehicle, or placing them in a stockpile for later use, or placing them in positions for installation, or even for actually installing the lengths in some instances. Alternatively, the crampon could be used for picking up lengths from a stockpile and loading them onto a vehicle, or placing them in positions for installation, or actually installing them.

To be able to handle lengths for such purposes, it is desirable to be able, not only to transport the pipe through short distances, but also conveniently to raise and lower a length, to translate a length transversely of its length, to swing a length about an upright axis, and to tilt a length. The crampon of the present invention is sufficiently versatile to be able to manipulate a length in these various ways quickly and conveniently.

Figure 2:
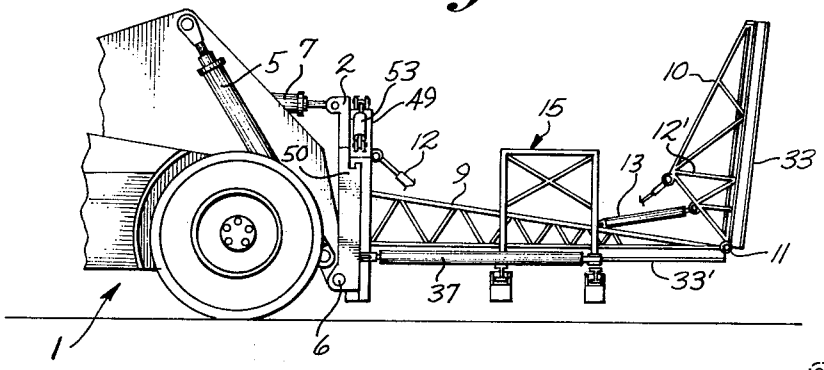
Figure 1:
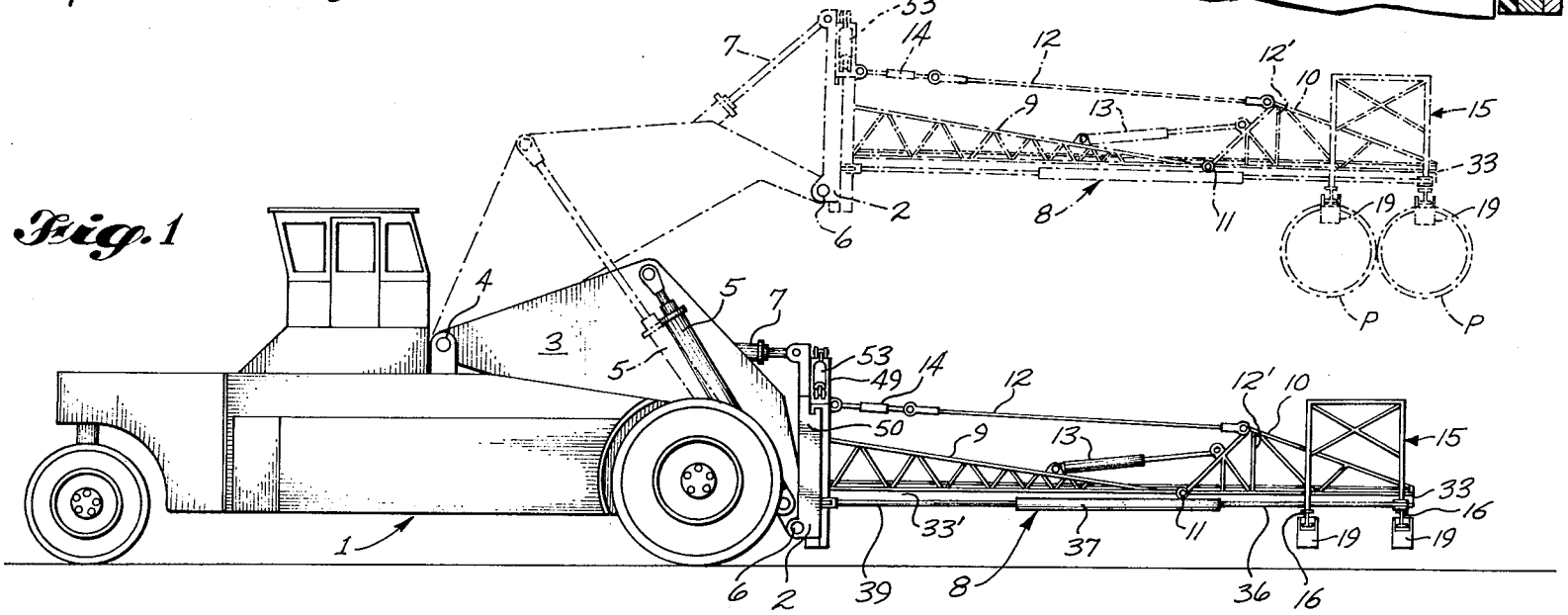

The length-handling crampon is provided as an attachment or an accessory for a lift truck 1 shown in FIGS. 1 and 2. The crampon attachment is directly mounted on an upright supporting strut 2 carried by the swinging end of a hoisting frame 3 swingably mounted on the lift truck by a horizontal pivot 4. Swinging of the frame about such pivots between the solid-line position and the broken-line position of FIG. 1 can be accomplished by a fluid-pressure jack 5 to alter the elevation of the upright crampon-supporting strut between the solid-line position and the broken-line position of FIG. 1.

In order to enable the strut 2 to be maintained in upright attitude in all swung positions of the frame 3, the lower portion of such strut is mounted on the swinging end of the frame by a horizontal pivot 6. The upper portion of the strut 2 is braced from the hoisting frame by a fluid-pressure jack 7 interconnecting such strut upper portion and the hoisting frame. As the effective length of the jack 5 is altered to effect corresponding swinging of the hoisting frame 3, the length of jack 7 can be changed correspondingly so that the supporting strut will remain upright despite the change in angle of the hoisting frame as it is swung about the axis of pivot 4 relative to the lift truck.

The length-handling crampon attachment includes a boom 8, the root end of which is carried by the upright strut 2. Such boom includes a cantilever inboard section 9 and an outboard draw section 10 attached by a pivot 11 to the free end of the inboard boom section 9. The upper portion of the outboard boom section is supported in its lowered position by guys 12 connected between the supporting strut 2 and anchor posts 12' on the boom draw section. The draw section of the boom can be swung between the horizontal position of FIG. 1 and the upwardly swung position of FIG. 2 by a fluid-pressure jack 13 connected between the inboard boom section and the outboard boom section 10. The guys 12 can include turnbuckles 14 adjustable to vary the lengths of the guys for distributing the load equally between them and for establishing the desired lowered position of the outboard boom section 10.

Figure 11:
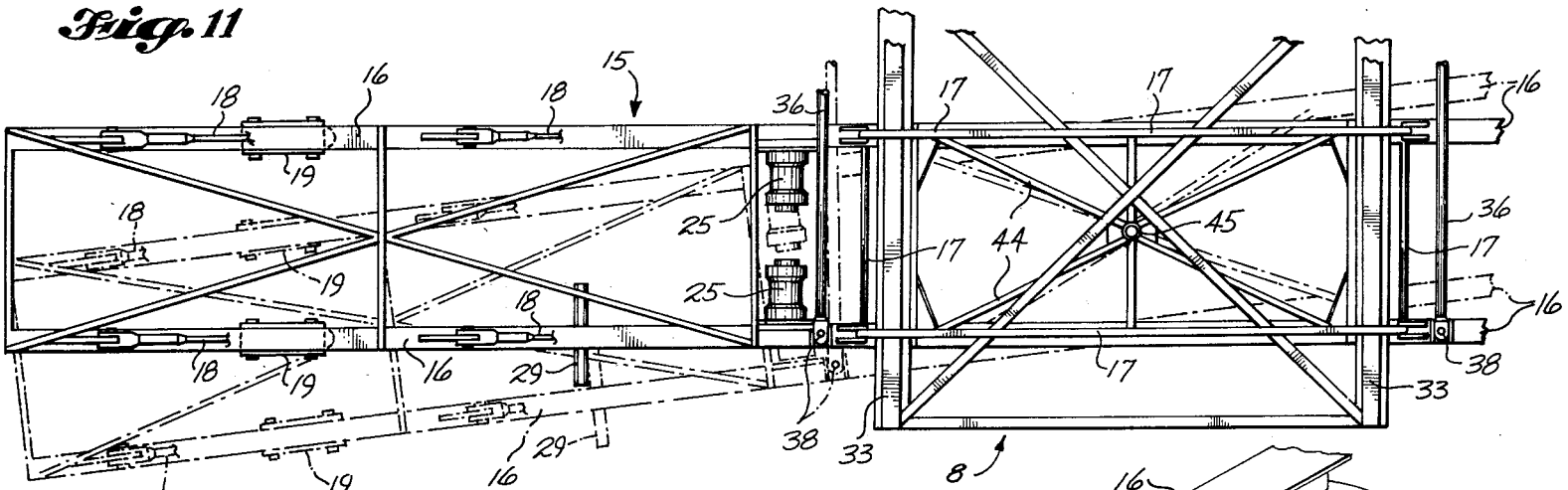
FIG. 11 is a plan of a portion of the crampon indicating pipe-swinging ability of the crampon.

An elongated frame 15 is carried by the boom with the length of such frame extending transversely of the length of the boom. As shown in FIG. 11, such frame includes at least one, and preferably two, longitudinal members 16 extending transversely of the length of the boom 8 and of a length at least as great as the length of the longest length to be handled. If two of such longitudinal members are provided in parallel relationship, two lengths, such as of pipe P, can be handled at the same time as indicated in broken lines in FIG. 1. Such longitudinal members are held in parallel relationship by suitable diagonal bracing, as illustrated in FIG. 11.

The longitudinal members 16 extend beneath the boom 8, as shown in FIG. 3, and superstructure 17 of the length-spanning frame extends over and includes supporting members at opposite sides of the boom, as shown in FIG. 3. Guys 18 span between such superstructure and different locations of the longitudinal members 16 spaced outward from the central portion of such longitudinal members to support such horizontal members without their end portions sagging. To enable the crampon to handle lengths which are quite long, longitudinal member extensions 16' shown in FIG. 9 can be attached to the opposite ends of the frame members 16 and their portions farthest from the frame members 16 are supported by guys 18'.

Figure 7:
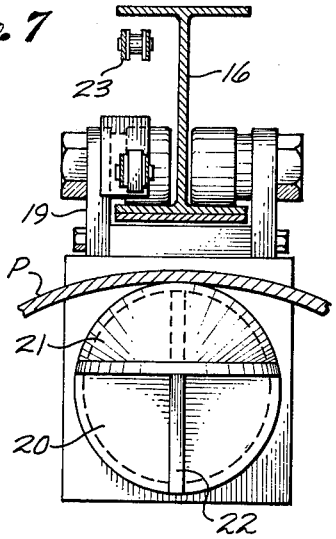
Figure 6:
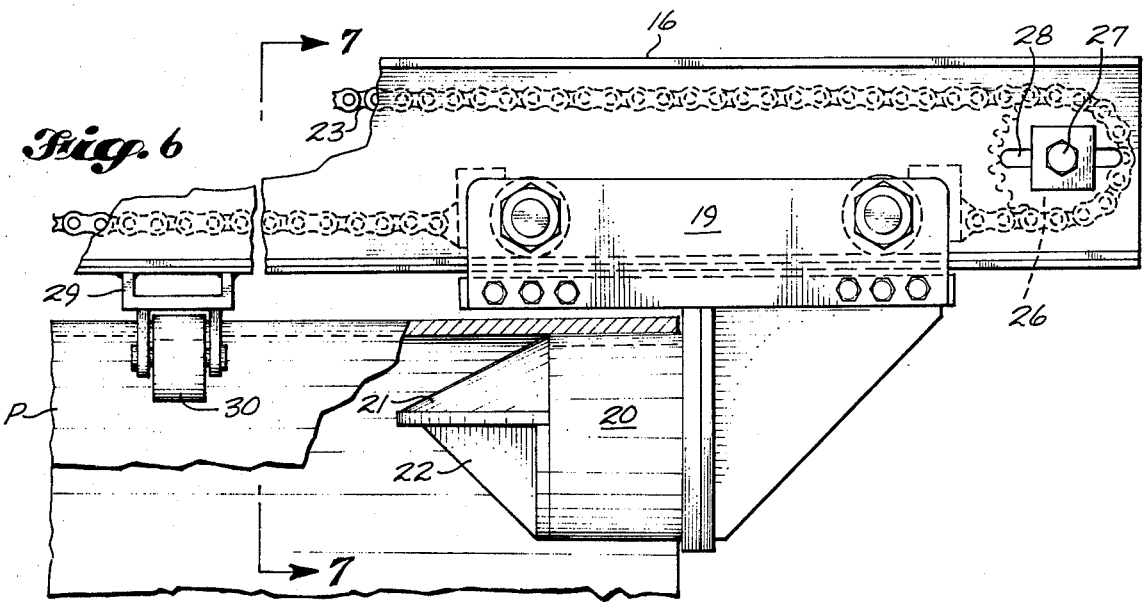

The opposite ends of pipe lengths P are gripped by gripping means movable lengthwise of the longitudinal frame members 16. Pipe-gripping members are mounted on carriages 19 riding on the lower flanges of the I beam longitudinal members 16 constituting tracks. Each pipe-gripping member may include a cylindrical pipe-gripping head 20 arranged with its axis parallel to the longitudinal member 16 and mounted by one end. A beveled nosing 21 supported by a bracket 22 projects from the opposite end of the head 20 to facilitate entry of the head into the end of a pipe. Such beveled nosing is of conical segmental shape at least approaching a semicone, as shown in FIGS. 6 and 7.

Figure 8:
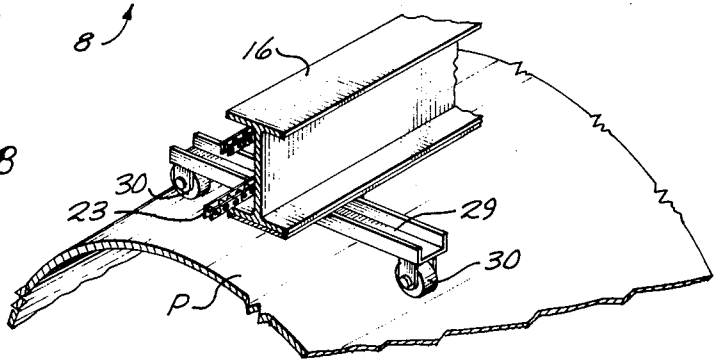
Figure 4:
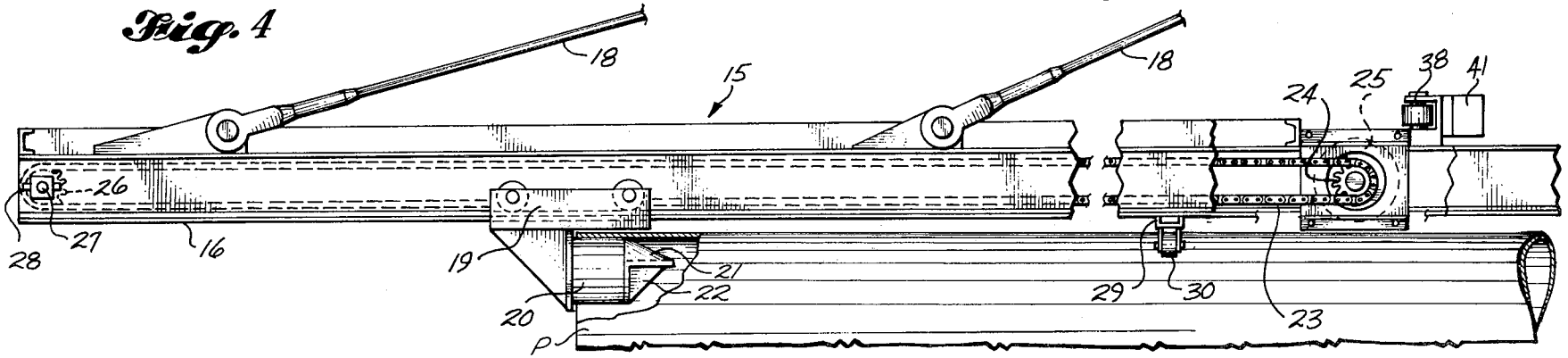
Figure 5:
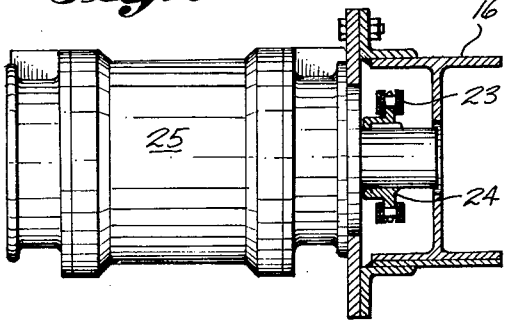

An endless loop drive chain 23 extends along each longitudinal member 16 of the length-spanning frame at each side of the superstructure 17. Opposite ends of each chain loop are connected to a carriage 19 carrying a pipe-engaging head 20, as shown in FIG. 6. Each chain is driven by a drive sprocket 24 (FIG. 5) mounted on a longitudinal member 16 adjacent to the superstructure 17. Such sprocket is rotated by a motor 25. The opposite end of the chain loop is supported by an idler sprocket 26 mounted on a shaft 27 passing through a slot 28 the length of which extends lengthwise of the longitudinal member 16. The shaft 27 can be adjusted along the length of the slot and clamped to the longitudinal member to tighten the drive chain 23. To grip a length of pipe, the motors 25 are operated to drive opposed carriages toward each other so that their heads are inserted into opposite ends of a pipe length. While thus gripped, the pipe is steadied against rocking by saddles (FIGS. 6 and 8) including crosspieces 29, the opposite ends of which carry rollers 30 engageable with the upper portion of a pipe P, as shown best in FIG. 8 so as to make the saddles of antifriction character to enable the pipe to roll into proper position as it is being engaged by a pipe-gripping head 20.

The length-spanning frame 15 is mounted on a carriage 31 shown in FIG. 12 having rollers 32 riding on the lower flanges of I beams 33 which form tracks. Such I beams constitute the longitudinal members of the outboard draw section 10 of the boom. When the draw section is in its lowered position of FIG. 1, such longitudinal members are aligned with corresponding longitudinal members 33' of the inboard boom section 9. The carriage 31 is maintained in the desired position transversely of the boom by thrust rollers 34 carried by the length-spanning frame carriage and riding along the webs of the I beam longitudinal boom members 33 and 33', as shown in FIG. 13.

The length-spanning frame carriage 31 can be moved along the boom toward and away from the lift truck 1 to translate lengths transversely of their length by carriage-traversing mechanism 35. Such carriage-traversing mechanism includes two fluid-pressure cylinders operating in tandem, the plunger 36 of one jack is movable relative to its cylinder 37 which is of the double-acting type so that it can operate either to draw plunger 36 into the cylinder or push it out of the cylinder. The end of such plunger remote from its cylinder is connected by pivot 38 to a portion of the length-spanning frame such as a longitudinal member 16. The other cylinder of the pair includes the plunger 39 having one end connected by a pivot 40 to the root end of the inboard boom section 9 and its opposite end received in cylinder 41 which also is of the double-acting type.

The two cylinders 37 and 41 are arranged alongside each other, and their central portions are mounted on a jack-supporting carriage 42, as shown in FIGS. 12 and 14. Such carriage is supported by rollers 43 rolling on the lower flanges of I beam longitudinal members 33' of the inboard boom section. By moving either plungers 36 or plungers 39 into their respective cylinders, the position of the length-spanning frame carriage along the longitudinal members 33 of the boom outboard section 10 can be adjusted to nearly any position. If all of the plungers are retracted fully into their respective cylinders, the carriage 15 can be shifted generally to the central portion of the inboard boom section 9, as shown in FIG. 2. With the carriage in this position, the jacks 13 can be contracted to swing the outboard boom section 10 into the upwardly swung or draw position of FIG. 2.

In some instances the boom 9, 10 may not be precisely perpendicular to a length which it is desired to span with the length-spanning frame and engage with the gripping members. To enable the length-spanning frame to be placed with its length parallel to the length of a length under such circumstances, the length-spanning frame is mounted on the boom so that it can be swung relative to the boom about an upright axis. To enable such an operation to be performed, the length-spanning frame carriage 31 includes substantially diagonal struts 44 crossing to support an upright pivot 45, as shown in FIG. 12. FIG. 3 shows that this pivot is above the pipe-engaging heads 20.

If the portions of the frame members 44 adjacent to the rollers 32 have underslung members 46 from which a lower flange 47 projects, the shelf formed by the upper side of each such flange is engaged by the horizontal flange of an angle member 48, the upright flange of which is welded to the upper flange of a longitudinal member 16 of the length-spanning frame 15 as shown in FIG. 13. The length-spanning frame can then be swung about the upright axis of pivot 45 by differential actuation of the compound jack mechanism 35. One of the cylinders 37 can push out its plunger 36 while the other cylinder is drawing in its plunger 36 correspondingly. Alternatively, one of the cylinders 41 can push its plunger 39 out while the other cylinder is drawing its plunger in correspondingly. By such manipulation of the cylinders, the length-spanning frame can be swung between the solid-line position and a broken-line position such as illustrated in FIG. 11.

In some instances it may be necessary for the lift truck 1 to approach a stockpile of lengths over uneven ground. In such an instance, the lift truck may be tilted relative to the lengths in a stack. The length-spanning frame can be tilted relative to the lift truck between the broken-line positions of FIG. 9 to compensate for such tilt of the lift truck and place the length-spanning frame parallel to the lengths to be handled. To enable the length-spanning frame to be thus tilted, the boom is mounted for swiveling relative to the lift truck. The boom-supporting arch 49 is engaged with an arcuate guide flange 50 (FIG. 10) forming the upper portion of the upright boom-supporting strut 2. The boom can swivel relative to the lift truck about the axis of a pivot 52 which extends lengthwise of the boom.

Figure 10:
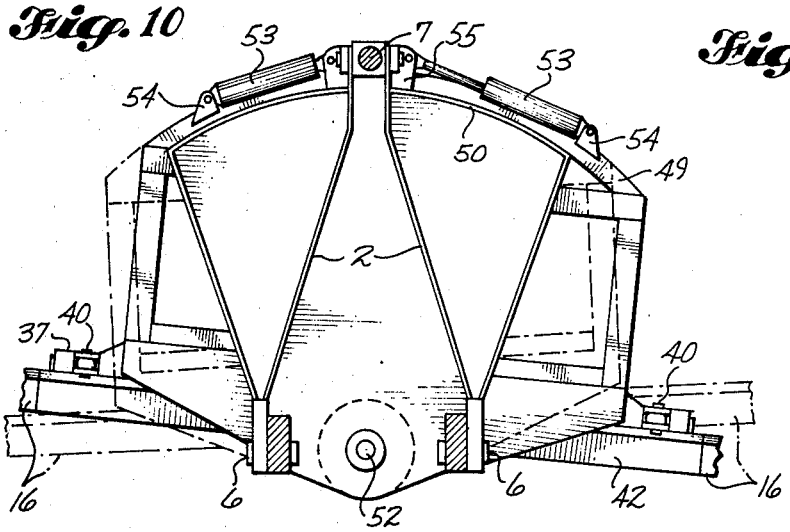
FIG. 10 is a transverse section taken on line 10—10 of FIG. 12 also indicating tilting ability of the crampon.

The degree to which the boom is swiveled relative to the lift truck is accomplished and controlled by fluid-pressure jacks 53 connected between lugs 54 on the boom arch 49 and a central projection 55 extending upward from the central portion of the arch guide flange 50. FIG. 10 shows one jack 53 contracted and the other jack 53 extended to swivel the boom to the solid-line position of that figure.

While the pipe-gripping heads 20 have been shown as including a beveled nosing 21 supported by a bracket 22, the type of gripping head 20' shown in FIG. 16 could be used instead to grip the end portion of a length of pipe, or other material such as the web of a channel, I beam or H beam. In this instance, the head carries a wheel 55 mounted on an axle 56 extending transversely of the direction of movement of the head. Such axle is supported by arms 57 projecting from the head 20'. As the head is moved toward the end of a pipe length to be handled, the pipe length end may engage the upper periphery of the wheel. Continued movement of the head toward the pipe length end will cause the wheel to rotate and lift the pipe end by rolling on the inner surface of the pipe end upper portion so as to slide the pipe end up and over the head 20. Such head has an elastomer coating 58 to prevent scraping of the pipe. The wheel would roll correspondingly on the underside of the end portion of other types of lengths.

A typical operation of the crampon would involve the lift truck approaching the side of a load of pipe lengths on a truck, raising the boom to the broken-line position of FIG. 1 with the outboard draw section raised and the pipe-spanning frame 15 carried by the inner section, as shown in FIG. 2. The boom would then be swiveled by operation of jacks 53 and swung by differential operation of the compound traversing jacks 35 to place the pipe-spanning frame in parallelism with one or two pipe lengths. The boom would next be lowered until the saddle rollers 30 rested on the pipes. The motors 25 can then be energized for driving chains 23 to shift carriages 19 along the longitudinal members 16 of the pipe-spanning frame to insert the pipe-gripping heads 20 into opposite ends of one or two generally parallel pipe lengths.

When one of the heads 20' shown in FIG. 16 has been engaged with one end of a length to, the end of such length will actuate a limit switch 59 to deenergize the motor driving that head while the motor driving the other head will continue to operate until such other head also has been engaged with its end of the length being handled.

Figure 9:
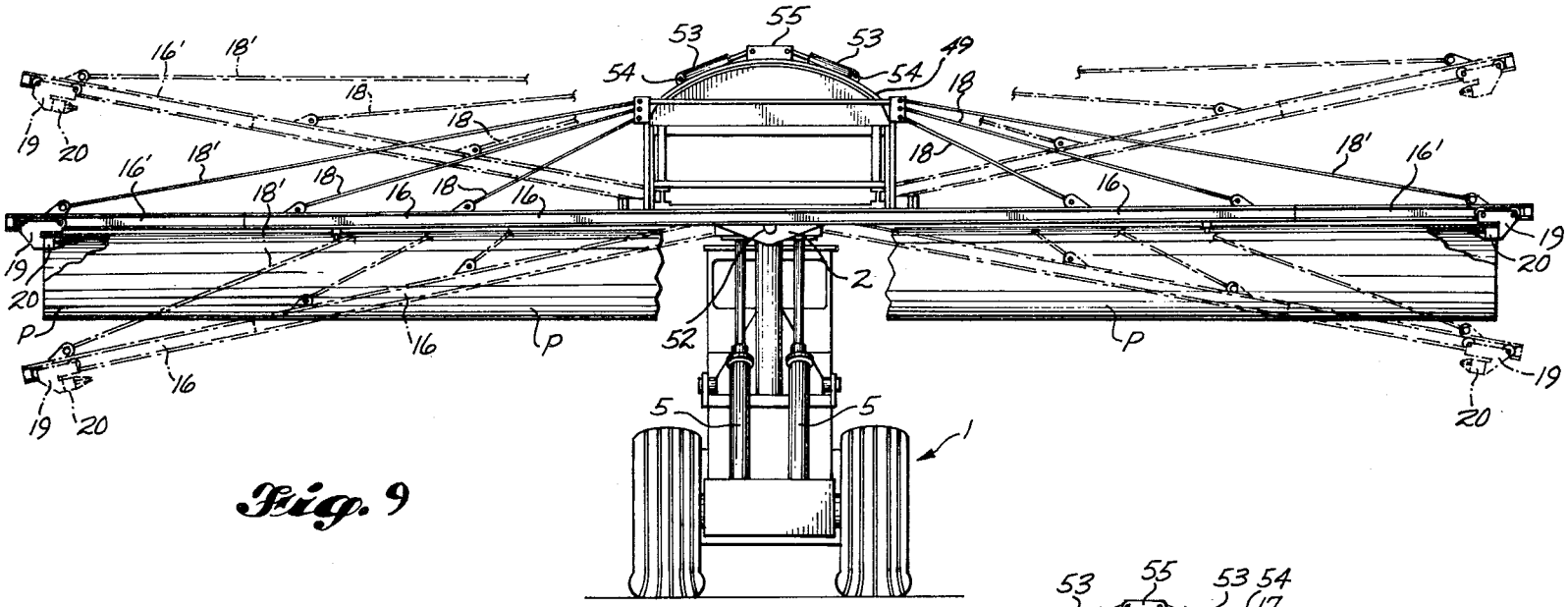
FIG. 9 is a front elevation of the pipe-handling crampon indicating tilting ability of the crampon.

With pipe lengths gripped as shown in FIG. 6, the jacks 5 would be operated to raise the boom and the pipes from the truck, as shown in broken lines in FIG. 1 and solid lines in FIG. 9. After the pipe is thus raised, the motors 25 can both be energized, but running in opposite directions, so that both carriages 19 will be moved conjointly in the same direction to shift the pipe lengthwise in one direction or the other to a centered or balanced position. The lift truck can then be driven to a stock-pile location, and the pipe lengths can be deposited on such stock pile by operating motors 25 in reverse to drive chains 23 and carriages 19 for withdrawing the pipe-gripping heads 20 from the opposite ends of the pipe lengths. In thus stacking the pipes on a stock pile, it may or may not be necessary to operate the compound jacks 35 for shifting the pipe-spanning frame outwardly along the boom.

If the pipes cannot be stacked in a desired location on a stock pile without extending the boom, the compound jacks 35 can be operated conjointly to shift the carriage 31 supporting the pipe-spanning frame from the position shown in FIG. 2 to the position shown in FIG. 1 in which the outboard draw section of the boom is swung downward by jacks 13. The length-spanning frame 15 can then be moved outward beyond the main section of the boom onto the draw section, as shown in broken lines in FIG. 1, for deposit of the pipe sections P at a considerable distance from the lift truck. Similarly, when it is desired to remove pipes from a stock pile, the boom may be extended by lowering the draw section from the position of FIG. 2 to the position of FIG. 1 to pick up pipes at a considerable distance from the lift truck. Because of the extended reach provided by the outboard draw section, stock piles can be made considerably higher than would otherwise be possible, for example, five tiers high for pipe four feet in diameter.

For handling short lengths of pipe the crampon can be used as shown in FIG. 15 in which the pipe-spanning frame extensions 16' have been omitted or removed from the pipe-spanning frame. The crampon in this form can be operated in the manner described above for handing pipe.

Moreover, while the length-spanning frame 15 has been shown as being supported on the boom of a lift truck, such frame could be supported in other ways for handling lengths, such as being carried by a swinging crane boom, or beng supported on the end of a hoisting line depending from a crane boom, or being mounted on a straddle carrier.

I claim:

1. A length-handling crampon for a lift truck having a boom projecting from and supported by the lift truck, comprising an elongated length-spanning frame carried by the boom with its length extending transversely of the length of the boom and its opposite end portions projecting substantial distances beyond opposite sides of the boom, powered frame-carrying means for moving said length-spanning frame transversely of its length along the boom toward and away from the lift truck, and remotely actuated power gripping means carried by said frame and engageable with a length to be handled for gripping such length.

2. The crampon defined in claim 1, and a hoisting frame mounted on the lift truck for swinging about a horizontal axis extending transversely of the boom to lift the boom in substantially constant horizontally projecting attitude through a substantial distance relative to the lift truck.

3. The crampon defined in claim 1, wherein the frame-carrying means including twin jacks having their cylinders disposed in side-by-side relationship and their plungers extending oppositely, respectively, and connected between the lift truck and the length-spanning frame, and means supporting said twin jack cylinders from the boom for movement longitudinally of the boom.

4. The crampon defined in claim 1, in which the boom includes an inboard section and an elongated outboard draw section mounted pivotally on said inboard section and swingable upward relative to said inboard section to dispose its length upright, the frame-carrying means being movable along both boom sections.

5. The crampon defined in claim 4, in which each of the inboard section and the outboard draw section of the boom includes elongated track means having its length extending lengthwise of the boom sections, and the frame-carrying means includes a carriage supporting the length-spanning frame and movable along said track means of both boom sections.

6. The crampon defined in claim 1, in which the boom includes elongated track means having its length extending lengthwise of the boom, and the powered frame-carrying means includes a carriage supporting the length-spanning frame and movable along said track means.

7. The crampon defined in claim 1, and means above the gripping means supporting the length-spanning frame for swinging about an upright axis relative to the boom for aligning the frame with a length to be gripped by the gripping means.

8. The crampon defined in claim 1, and means supporting the length-spanning frame for tilting relative to the lift truck about a generally horizontal axis extending transversely of the length of the frame and for movement toward and away from the lift truck parallel to such axis in various tilted positions.

9. The crampon defined in claim 1, and means supporting the boom from the lift truck for swiveling relative to the lift truck to tilt the length-spanning frame relative to the lift truck.

10. The crampon defined in claim 1, in which the gripping means includes two sets of pipe-gripping members engageable with two lengths of pipe, respectively, the pipe-gripping members of each set being movable lengthwise of the length-spanning frame independently of the pipe-gripping members of the other set.

11. The crampon defined in claim 1, including two gripping means for engagement with opposite ends, respectively, of a length to be handled, and drive means for moving the two gripping means longitudinally of the length-spanning frame toward each other.

12. The crampon defined in claim 11 in which the drive means includes two endless chains carried by the length-spanning frame for moving the two gripping means, respectively, lengthwise of the frame and motor means for driving said endless chains.

13. The crampon defined in claim 1, in which the gripping means includes a pipe-engaging head having a beveled nosing of conical segmented shape insertable into the end of a length of pipe.

14. The crampon defined in claim 1, including power drive means for driving a gripping means along the length-spanning frame toward the end of a length to be handled, and means actuatable by the end portion of such a length for deenergizing said power drive means when such gripping means has reached a predetermined relationship to such end of the length to be handled.

15. The crampon defined in claim 1, and antifriction saddle means for steadying a pipe length carried by the length-spanning frame, engageable with the upper side of the pipe length at a location between the ends of the pipe length gripped by the gripping means and spaced from the gripping means.

16. The crampon defined in claim 1, in which the gripping means includes a head having a wheel rotatably mounted on said head for engagement of the upper periphery of said wheel with an underside of an end portion of a length to be handled to roll along such underside.

17. A length-handling crampon comprising supporting means, an elongated length-spanning frame carried by said supporting means two gripping means for gripping opposite end portions, respectively, of a length to be handled, mounting means carried by said frame and supporting said two gripping means rigidly relative to and close beneath said frame, and remotely-actuated power means for effecting relative movement of said two gripping means lengthwise of said frame to alter the spacing therebetween for gripping lengths of different length by remote control.

18. The crampon defined in claim 17, in which the supporting means is above the two gripping means and supports the length-spanning frame for swinging about an upright axis substantially midway between the two gripping means for aligning the frame with a length to be gripped by the gripping means.

19. The crampon defined in claim 17, in which the power means includes an endless chain carried by the length remotely actuated spanning frame for moving each of the gripping means lengthwise of the frame and a motor for driving said endless chan.

20. The crampon defined in claim 17, in which the gripping means includes a pipe-engaging head having a beveled nosing insertable into the end of a length of pipe.

21. The crampon defined in claim 17, in which the gripping means includes a head having a wheel rotatably mounted on said head for engagement of the upper periphery of said wheel with an underside of an end portion of a length to be handled to roll along such underside.

22. The crampon defined in claim 19, in which the length-spanning frame includes elongated track means having its length extending lengthwise of the length-spanning frame and the mounting means includes two carriage means carrying the gripping means, respectively, and movable along said track means.

23. The crampon defined in claim 22, in which the supporting means supports the length-spanning frame for tilting about a generally horizontal axis substantially perpendicular to the track means and substantially as high as the portion of the gripping means engageable with the upper side of a length to be handled.

24. The crampon defined in claim 22, in which the gripping means includes two sets of length-gripping members movable independently longitudinally of their respective track means to vary the spacing thereof for engagement, respectively, with the end portions of two lengths which are of different lengths.

25. A length-handling crampon for a lift truck having a boom projecting from and supported by the lift truck, comprising an elongated length-spanning frame carried by the boom with its length extending transversely of the length of the boom, gripping means carried by said frame and engageable with a length to be handled for gripping such length, and means supporting said frame for swinging about an upright axis relative to the boom for aligning said frame with a length to be gripped by said gripping means.

26. A length-handling crampon for a lift truck having a boom projecting from and supported by the lift truck, comprising an elongated length-spanning frame carried by the boom with its length extending transversely of the length of the boom, means supporting the boom from the lift truck for swiveling relative to the lift truck to tilt said frame relative to the lift truck, and gripping means carried by said frame and engageable with a length to be handled for gripping such length.

* * * * *

UNITED STATES PATENT OFFICE

CERTIFICATE OF CORRECTION

Patent No. 4,029,217 Dated June 14, 1977

Inventor(s) Charles Richard Morse

It is certified that error appears in the above-identified patent and that said Letters Patent are hereby corrected as shown below:

Column 7, line 40, insert a comma after "11".

Column 8, line 3, insert a comma after "supporting means"; line 19, insert --remotely actuated-- before "power"; line 20, cancel "length remotely actuated spanning" and insert --length-spanning--; line 22, cancel "chan" and insert --chain--; line 33, cancel "19" and insert --17--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

Patent No. 4,029,217 Dated June 14, 1977

Inventor(s) Charles Richard Morse

It is certified that error appears in the above-identified patent and that said Letters Patent are hereby corrected as shown below:

Column 6, line 55, cancel "including" and insert --includes--

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*